US009687046B2

(12) United States Patent
Wojcieszak et al.

(10) Patent No.: US 9,687,046 B2
(45) Date of Patent: Jun. 27, 2017

(54) REVERSABLE STRAP FOR AN ARTICLE OF FOOTWEAR

(71) Applicant: Wolverine Outdoors, Inc., Rockford, MI (US)

(72) Inventors: Craig M. Wojcieszak, Medford, MA (US); Keith J. Fudalik, Chelmsford, MA (US)

(73) Assignee: Wolverine Outdoors, Inc., Rockford, MI (US)

( * ) Notice: Subject to any disclaimer, the term of this patent is extended or adjusted under 35 U.S.C. 154(b) by 8 days.

(21) Appl. No.: 14/857,210

(22) Filed: Sep. 17, 2015

(65) Prior Publication Data

US 2017/0079380 A1 Mar. 23, 2017

(51) Int. Cl.

| | |
|---|---|
| ***A43C 11/00*** | (2006.01) |
| ***A43C 11/14*** | (2006.01) |
| ***A43C 11/06*** | (2006.01) |
| ***A43B 3/00*** | (2006.01) |
| ***A43B 3/24*** | (2006.01) |

(52) U.S. Cl.

CPC ..... *A43C 11/004* (2013.01); *A43B 3/0078* (2013.01); *A43B 3/242* (2013.01); *A43C 11/06* (2013.01); *A43C 11/1493* (2013.01)

(58) Field of Classification Search

CPC ... A43C 11/004; A43C 11/06; A43C 11/1493; A43B 3/0078; A43B 3/242

See application file for complete search history.

(56) References Cited

U.S. PATENT DOCUMENTS

| | | | | |
|---|---|---|---|---|
| 1,855,345 | A * | 4/1932 | Fischer, Jr. | A43C 11/22 36/58.5 |
| 2,049,347 | A * | 7/1936 | Benjamin | A43B 1/0027 36/50.1 |
| 6,574,887 | B2 * | 6/2003 | Jones | A43B 1/0027 36/100 |
| 6,848,199 | B1 * | 2/2005 | Giannelli | A43B 13/36 36/101 |
| 7,318,290 | B2 * | 1/2008 | Jones | A43B 1/0027 36/100 |
| 7,464,488 | B2 | 12/2008 | Jones et al. | |
| D642,772 | S * | 8/2011 | Tonkel | D2/897 |
| D643,188 | S * | 8/2011 | Tonkel | D2/897 |
| 2005/0039345 | A1 * | 2/2005 | Jones | A43B 1/0027 36/11.5 |
| 2006/0242861 | A1 * | 11/2006 | Dushey | A43B 3/103 36/101 |
| 2015/0033583 | A1 | 2/2015 | Loverin et al. | |

* cited by examiner

*Primary Examiner* — Ted Kavanaugh

(74) *Attorney, Agent, or Firm* — Warner Norcross & Judd LLP

(57) ABSTRACT

A reversible strap for an article of footwear is provided. The reversible strap includes a strap-end and a strap-body. The strap-body includes a first surface on one side thereof and a second surface on the other side thereof, such that the wearer can manually manipulate the strap-body to select between the two surfaces, which are visually distinguishable from each other. The strap-end detachably secures the strap-body to the article of footwear and can complement one or more visual markings on the strap-body.

21 Claims, 9 Drawing Sheets

REVERSABLE STRAP FOR AN ARTICLE OF FOOTWEAR

BACKGROUND OF THE INVENTION

The present invention relates to footwear and, more particularly, to a reversible strap for an article of footwear.

There are a variety of styles and designs of footwear, including shoes, sandals, boots, and the like, including features that serve functional and aesthetic purposes. For example, many footwear constructions include hook and loop straps. Hook and loop straps provide easy and rapid closure, varying degrees of tightness, and uniform support for the foot. While serving a functional role, these and other straps can include decorative elements to add to the aesthetic appeal of the article of footwear.

Hook and loop straps are typically are limited to a single aesthetic appearance, however. While reversible tongues and reversible sandals are known, their reversible constructions are not well suited for hook and loop straps or other strap closures, including buckle clasps, magnetic clasps, and other attachments. Accordingly, there remains a need for an article of footwear having straps that can be configured by the wearer. In particular, it would be advantageous to provide an adjustable strap that can be easily reversed to change the aesthetic appearance of the article of footwear.

SUMMARY OF THE INVENTION

A reversible strap for an article of footwear is provided. The reversible strap includes a strap-end and a strap-body. The strap-body includes a first surface on one side thereof and a second surface on the other side thereof. The wearer can manually manipulate the strap-body to select between the two surfaces, which are visually or functionally distinguishable from each other. The strap-end detachably secures the strap-body to the article of footwear and can complement any visual markings on the strap-body.

In one embodiment, the strap-body is reversible and the strap-end is non-reversible. The strap-body may include an attachment on both sides so that regardless of the orientation of the strap-body, there is an attachment on the upper side of the strap-body and an attachment on the lower side of the strap-body. The strap-end may be configured to cover and conceal the attachment on the upper side. The strap-end may include an attachment that is operatively engaged with the attachment on the upper side of the strap-body. The strap-end may also include an attachment that is operatively engaged with a corresponding attachment on the upper.

In another embodiment, the strap-body is anchored to the medial or lateral upper of the article of footwear. The strap-body is twistable about its longitudinal axis between a first position in which a first surface is displayed and a second position in which a second surface is displayed. The strap-body includes an end portion with an attachment on opposing sides thereof, and includes a double-sided construction having first and second coextensive layers joined about their respective periphery.

In still another embodiment, the strap-end is rotatably joined to the strap-body, and includes a displayable side opposite an attachment side. The displayable side can complement visual markings on the strap-body, and the attachment side can secure the strap-end to the upper and/or to the strap-body. For example, the strap-end can include a bottom layer for attachment to the upper and a top layer extending over the bottom layer for attachment to the strap-body. In this example, an attachment can detachably join the strap-end to both of the strap-body and the upper. Further by example, the strap-end can include a single layer for attachment to the strap-body. In this example, an attachment can detachably join the strap-end to only the strap-body, and not the upper. The attachment can include, for example, a hook and loop attachment, a snap attachment, a friction attachment, or a magnetic attachment.

The reversible strap can provide a quick and convenient manner in which the aesthetic appearance of the article of footwear may be adjusted. For example, the user can detach the strap-end from the upper, pulling back on the reversible strap. The user can then detach the strap-end top layer from the strap-body and rotate the strap-body about its longitudinal axis. With a different surface showing, the user can re-attach the strap-end top layer to the strap-body and lower the reversible strap onto the article of footwear. The upper engages the attachment of the strap-end and the strap-body to provide improved retention of the reversible strap.

In another embodiment, the strap-end is joined to the upper, rather than to the strap-body, and includes a panel extending over the end portion of the strap-body. The panel includes a displayable side opposite an attachment side. The displayable side can complement visual markings on the strap-body, and the attachment side can engage the strap-body, such that the strap-body is sandwiched between the panel and the upper. The strap-body is twistable about its longitudinal axis between a first position in which a first surface is displayed and a second position in which a second surface is displayed. The first and second surfaces can provide different visual indicia or different functional characteristics, for example. In use, the wearer can detach the panel from the strap-body and pull back on the strap-body. The wearer can then rotate or twist the strap-body such that a different surface is visible. The wearer can then lower the strap-body onto the upper and lower the panel onto the strap-body. Both the strap-end and the upper engage the strap-body to provide improved retention of the reversible strap.

These and other advantages and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
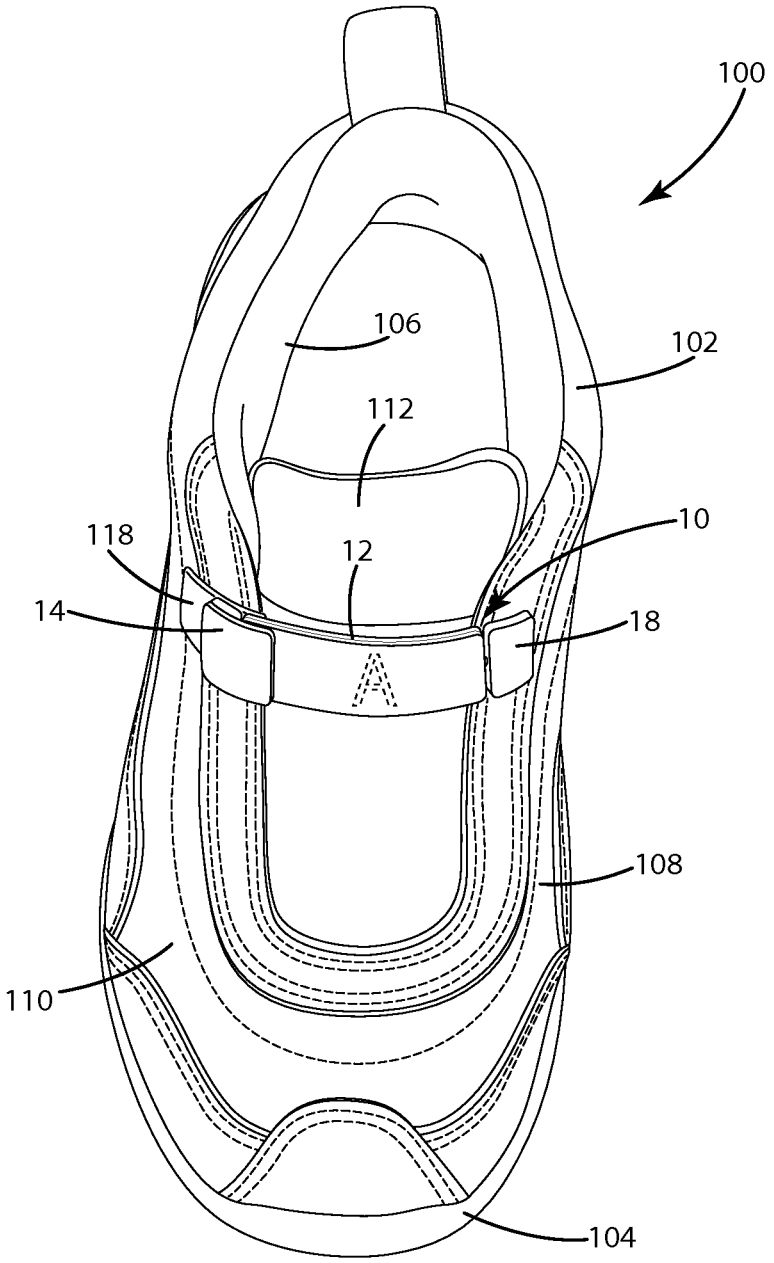
FIG. 1 is a top plan view of an article of footwear including a reversible strap in the closed position with a first surface visible.

The current embodiments relate to a reversible strap including a first surface on one side thereof and a second surface on the other side thereof, such that the wearer can manually manipulate the reversible strap to select between the first and second surfaces. While described as relating to an athletic shoe, the reversible strap can be included on any article of footwear, including sandals, boots, flats, and hiking shoes, for example. In addition, the reversible strap may be a closure in some embodiments, while in other embodiments the reversible strap may not be a closure.

To assist in an understanding of the current embodiments, several terms are defined herein. The term "visual indicia" includes any visual depiction, such as a color, a word, a graphic, or a pattern. For example, the reversible strap may include a first visual indicia on an upper surface and second, different, visual indicia on a lower surface. The term "upper surface" includes the major surface that is outwardly visible when the reversible strap is fastened. The term "lower surface" includes the major surface opposite of the upper surface. Lastly, the term "longitudinal axis" includes the lengthwise axis of symmetry of the reversible strap.

Referring now to FIGS. 1-4, a reversible strap is depicted and generally designated 10. The reversible strap 10 forms part of an article of footwear 100. The article of footwear 100 includes an upper 102 and a sole component 104. The upper 102 is formed from material elements that are joined together to cover at least a portion of the wearer's foot. The material elements can be selected based on the intended uses of the article of footwear 100, and can include synthetic textiles, mesh textiles, polymers or leather, for example. In other embodiments, the upper may be formed of a single material element, including for example a sandal strap. The upper 102 additionally includes an upper opening 106 for receiving the wearer's foot. The reversible strap 10 can extend from a medial portion of the upper 108 to a lateral portion of the upper 110 and over a tongue 112 to secure the upper 102 about the wearer's foot.

The sole component 104 provides protection for the wearer's sole, while also providing flexibility for a range of foot movements. The sole component 104 includes a midsole 114 and an outsole 116 in the illustrated embodiment, but greater or fewer elements of the sole component 104 can be included in other embodiments. For example, some embodiments can include only an outsole, while other embodiments can include an outsole, a midsole, and an insole. Still other embodiments can include a unit sole, in which the midsole and the outsole are combined into a unitary element.

Figure 5:
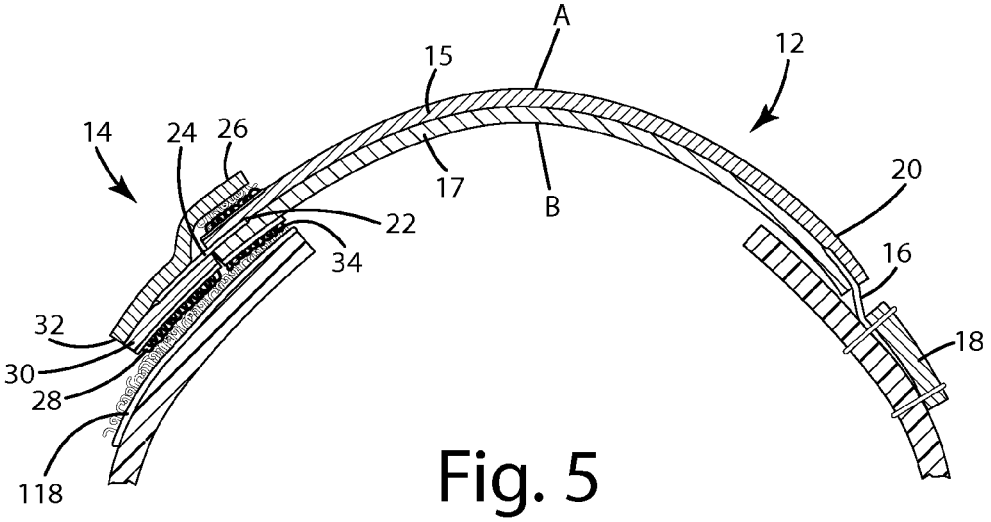
FIG. 5 is a cross-sectional view of the reversible strap of FIG. 1 in accordance with a first embodiment.
Figure 6:
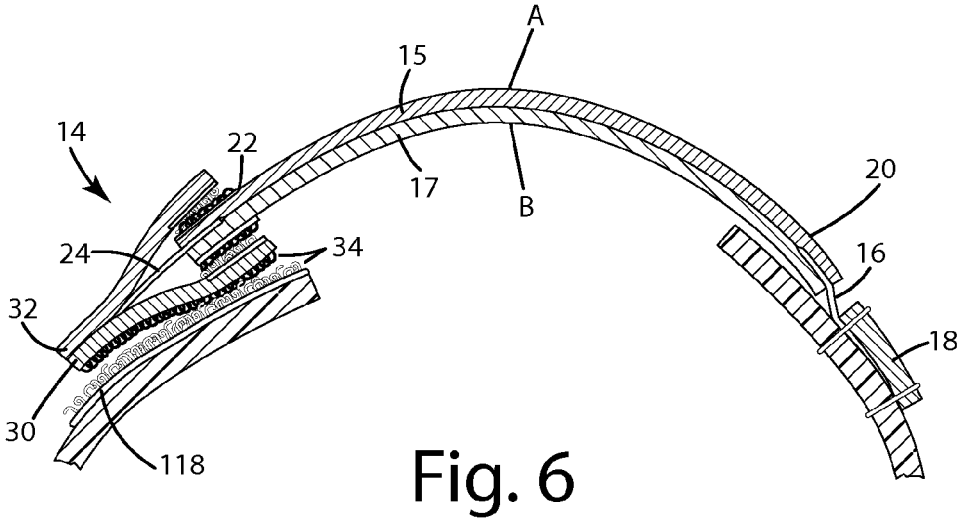
FIG. 6 is a cross-sectional view of the reversible strap of FIG. 1 in accordance with a second embodiment.

The reversible strap 10 includes a strap-body 12 and a strap-end 14. The strap-body 12 is rotatably joined to the upper 102, such that the strap-body 12 can be twisted about its longitudinal axis. The strap-body 12 is joined to a first rotatable element or anchor 16, which is joined to the upper 102. The anchor 16 can include any construction that is twistable with manual manipulation of the strap-body 12. For example, the anchor 16 can include one or more strips of flat shoe lace, round shoe lace, flat elastic gore, round elastic gore, leather, polyurethane, or other textile. Where two or more strips are used, the strips can be arranged in an "X", such that the anchor 16 is rotatable about the juncture between the two strips. The anchor 16 can be sewn or otherwise fixedly attached to the upper 102, optionally being sandwiched between a layer of webbing 118 and the upper 102 as shown in FIGS. 5-6.

As also shown in FIGS. 1-4, the strap-body 12 is anchored to the medial upper 108, extending to the lateral upper 110. In other embodiments the strap-body 12 is anchored to the lateral upper 110, extending to the medial upper 108. The strap-body 12 includes a first end portion 20 joined to the anchor 16 and a second, distal end portion 22 joined to the strap-end 14. The strap-body 12 can include any construction in which different visual indicia are presenting on opposing major surfaces. The strap-body can be formed of synthetic textiles, mesh textiles, polymers or leather, for example. For example, the strap-body 12 can include a double-sided construction, in which first and second coextensive layers are stitched together about their respective periphery. The first layer includes a first surface 15 and the second layer includes a second surface 17. In this construction, the first surface 15 includes a first visual indicia (represented by the letter A in FIG. 1) and the second surface 17 includes a second visual indicia (represented by the letter B in FIG. 3). As noted above, the visual indicia can include one or more colors, words, graphics, patterns, and combinations of the foregoing. For example, the first visual indicia can include a first graphic, and the second visual indicia can include a second graphic different from the first graphic.

Figure 2:
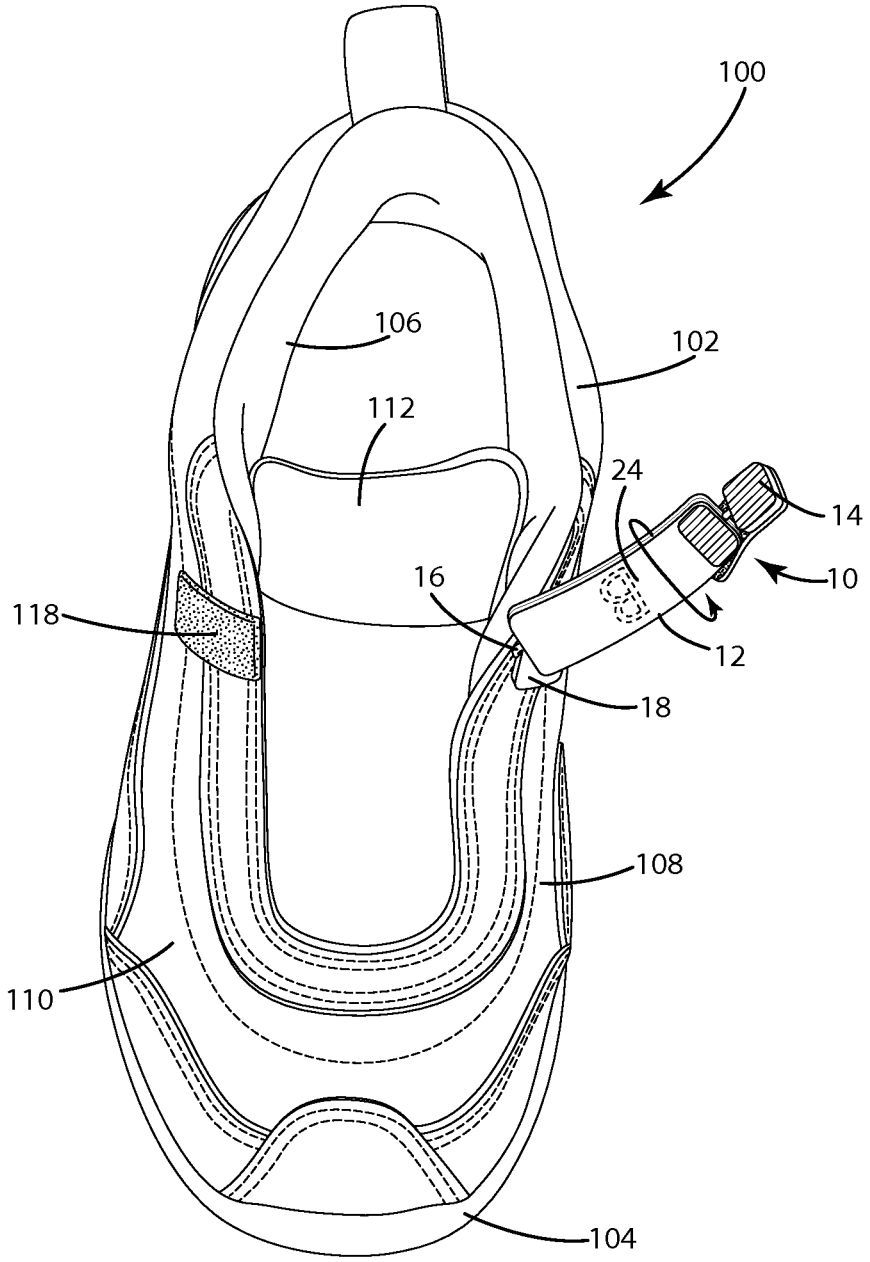
FIG. 2 is a top plan view of an article of footwear including the reversible strap of FIG. 1 in the open position.

The strap-end 14 is rotatably joined to the second end portion 22 of the strap-body 12. In particular, the strap-body 12 is twistable relative to the strap-end 14 with manual manipulation of the strap-body 12 when the reversible strap 10 is in an open position as shown in FIG. 2. The strap-end 14 can be joined to the strap-body 12 by a second rotatable element or tether 24. Like the anchor 16, the tether 24 can include any construction that is twistable with manual manipulation of the strap-body 12. For example, the tether 24 can include one or more strips of flat shoe lace, round shoe lace, flat elastic gore, round elastic gore, leather, polyurethane, or other textile. Where two or more strips are used, the strips can be arranged in an "X", such that the tether 24 is rotatable about the juncture between the two strips.

Figure 4:
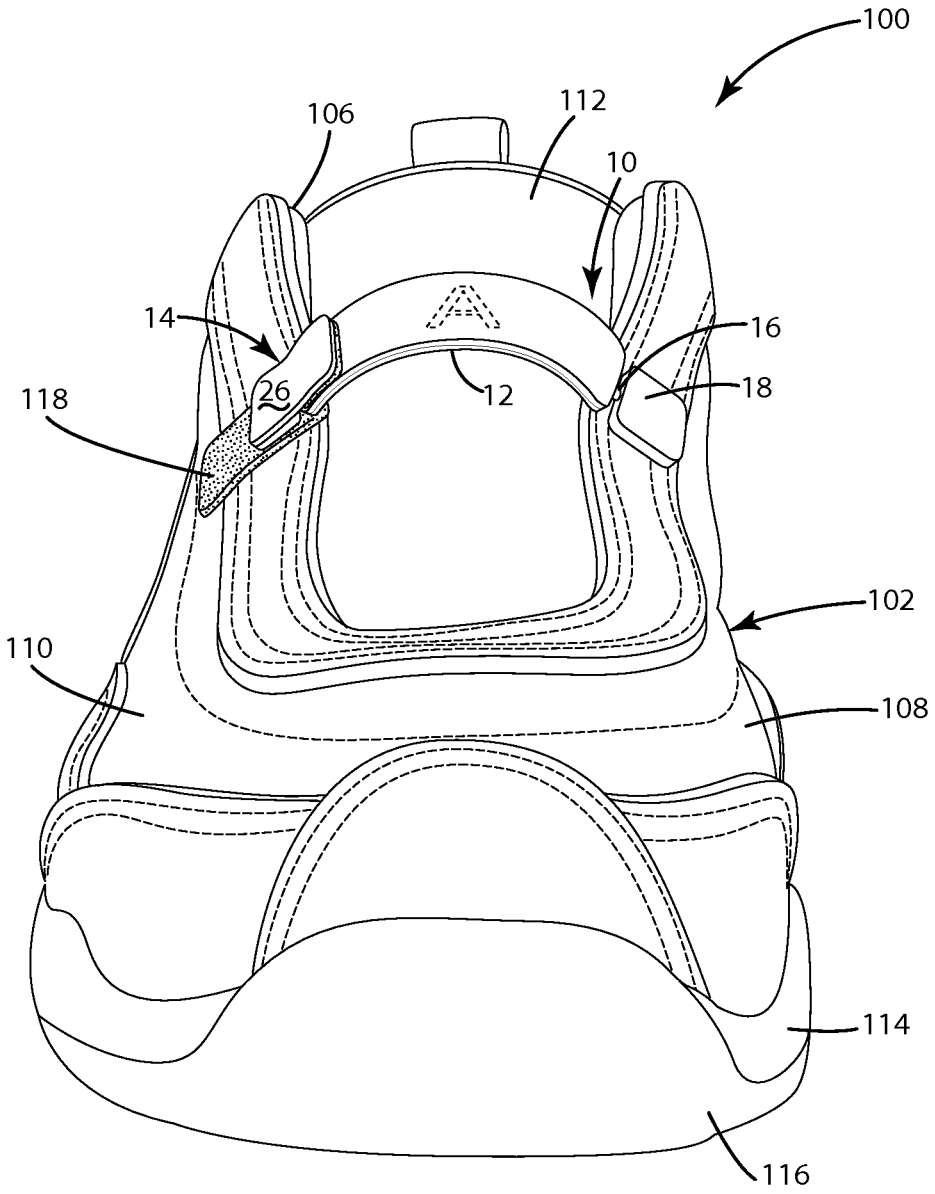
FIG. 4 is a front elevation view of an article of footwear including the reversible strap of FIG. 1 in the closed position.

The strap-end 14 is adapted to join the strap-body 12 to the upper 102. The strap-end 14 includes a displayable side 26 and an attachment side 28. The displayable side 26 is generally shown in FIG. 4, and can complement the visual indicia on the strap-body 12 when the reversible strap 10 is seated over the upper 104. The attachment side 28 is opposite of the displayable side 26, and secures the strap-end 14 to the upper 102. For example, the strap-end 14 can include a bottom layer 30 for attachment to the upper 102. The strap-end 14 includes a top layer 32 that is oversized with respect to the bottom layer 30, extending over the second end portion 22 of the strap-body 12 as shown in FIG. 5. The tether 24 is secured between the top and bottom layers 32, 30 where they otherwise meet. The strap-body 12 can be formed of synthetic textiles, mesh textiles, polymers, leather, or paper, for example.

An attachment 34 detachably joins the strap-end 14 to both of the strap-body 12 and the upper 102. The attachment 34 can include, for example, a hook and loop attachment, a snap attachment, a friction attachment, or a magnetic attachment. The attachment 34 includes a hook and loop attachment in the illustrated embodiment. For example, the second end portion 22 of the strap-body 12 includes a loop fastener on opposing surfaces thereof. The downward facing surface of the top layer 32 of the strap-end 14 includes a hook fastener to engage either surface of the strap-body 12. The downward facing surface of the bottom layer 30 of the strap-end 14 includes a loop fastener to directly or indirectly engage the upper 102. The upper 102 includes, on an upward facing mating surface 118, a hook fastener to engage both of the strap-end 14 and the strap-body 12. The mating surface 118 is generally oversized with respect to the strap-end 14, such that the reversible strap 10 can be tightened or loosened with respect to the upper 102 during normal wear.

In these and other embodiments, the second end portion 22 of the strap-body 12 includes upper and lower receiving surfaces, and the strap-end 14 includes a downward facing mating surface to selectively engage the strap body 12 and a downward facing receiving surface to selectively engage the upper 102. Similarly, the upper 102 includes an upward facing mating surface 118 to selectively engage the receiving surfaces of the strap-end 14 and the strap-body 12. Consequently, the upper and lower receiving surfaces of the strap-body 12 are sandwiched between the strap-end 26 and the upper 102 when the reversible strap 10 is seated over the upper 102. The receiving surfaces are described as being loop fasteners and the mating surfaces are described as being hook fasteners, but in other embodiments the receiving surfaces can be hook fasteners and the mating surfaces can be loop fasteners. In addition, the mating surfaces can include magnets to engage the receiving surfaces in the foregoing manner. Other attachments include snap attachments and friction attachments, for example.

Figure 3:
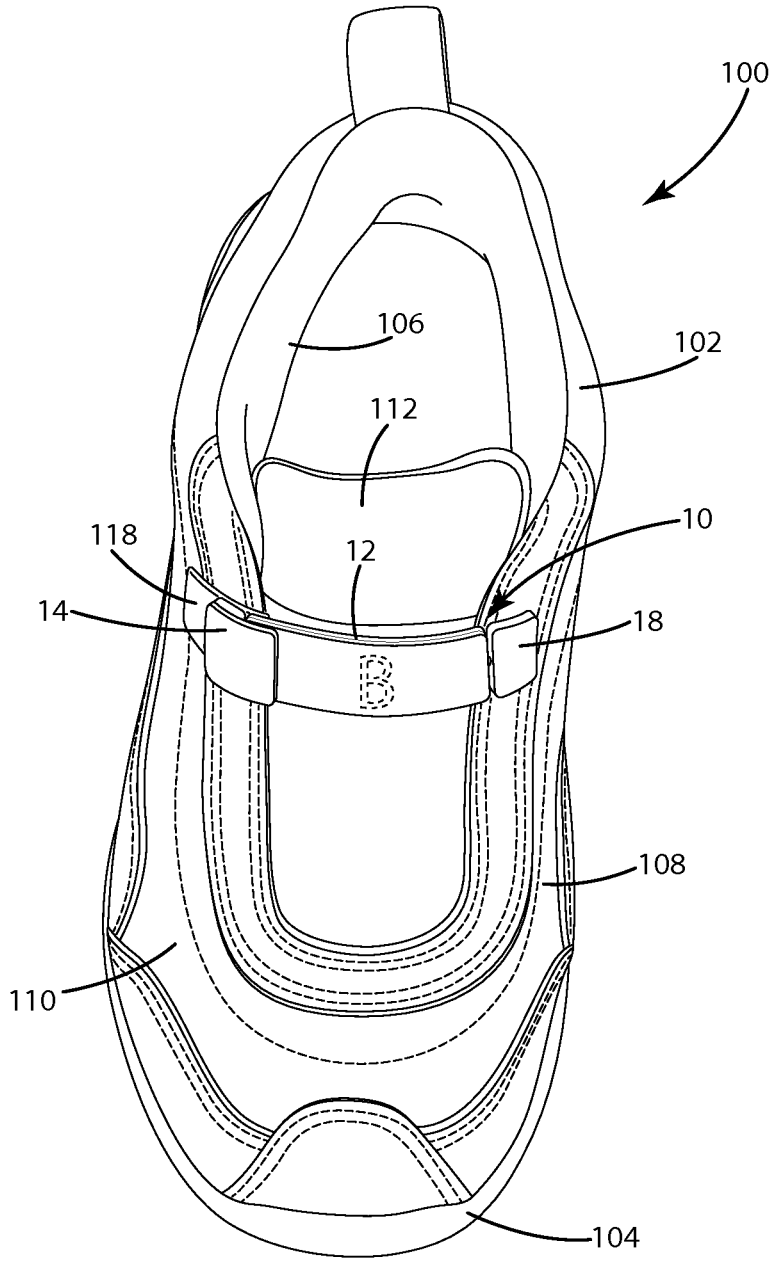
FIG. 3 is a top plan view of an article of footwear including the reversible strap of FIG. 1 returned to the closed position with a second surface visible.

The reversible strap 10 can be manually manipulated as follows. Beginning from the closed position as shown in FIG. 1, the wearer can pull back on the strap-end 14. The strap-end 14 and the strap-body 12 release from the upper 102, drawing back as shown in FIG. 2. From this open position, the wearer can detach the upper layer 32 of the strap-end 14 from the strap-body 12. Once detached, the wearer can rotate or twist the strap-body 12 180-degrees about its longitudinal axis. Once rotated, the wearer can reattach the upper layer 26 of the strap-end 14 to the strap-body 12. The wearer can then lower the strap-end 14 and the strap-body 12 as an integrated reversible strap 10 onto the upper 102. From the closed position as shown in FIG. 3, the reversible strap 10 now presents a different surface of the strap-body 12. This process may be completed as desired to permit the wearer to easily change the aesthetic appearance of the article of footwear 100. The strap-end 14 is non-reversible, and covers and conceals the attachment 34 on the reversible strap-body 12 in the closed position.

In another embodiment as shown in FIG. 6, the strap-end 14 can include a lower layer 30 that is coextensive with the upper layer 32, such that the strap-body 12 is sandwiched therebetween. The tether 24 is secured between the upper and lower layers 32, 30 permitting rotation of the strap-body 12 relative to the strap-end 14. This embodiment is similar in structure and in function to the embodiment of FIG. 5, except that the strap-body 12 does not directly engage the mating surface 118 of the upper 102. It should be noted that the tether 24, and may be entirely omitted in other embodiments, including the embodiments of FIGS. 5 and 7.

The reversible strap 10 according to this embodiment can be manually manipulated as follows. Beginning from the closed position 1, the wearer can pull back on the strap-end 14. The strap-end 14 then releases from the upper 102, drawing back as shown in FIG. 2. From this open position, the wearer can detach the upper and lower layers 32, 30 of the strap-end 14 from the strap-body 12. Once detached, the wearer can rotate or twist the strap-body 12 180-degrees about its longitudinal axis. Once rotated, the wearer can reattach the upper and lower layers 32, 30 of the strap-end 14 to the strap-body 12. The wearer can then lower the strap-end 14 as an integrated reversible strap 10 onto the upper 102. From the closed position, the reversible strap 10 now presents a different surface of the strap-body 12.

Figure 7:
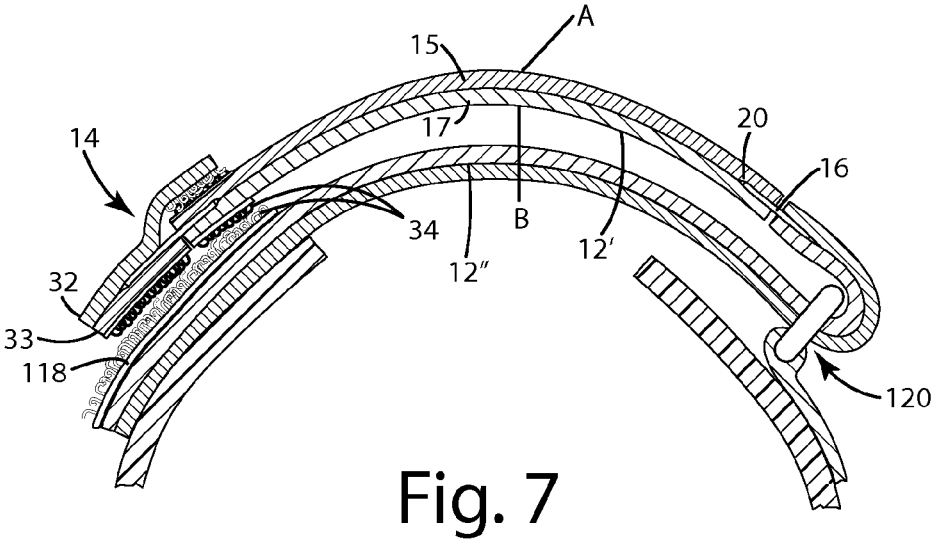
FIG. 7 is a cross-sectional view of the reversible strap of FIG. 1 in accordance with a third embodiment.

In another embodiment as shown in FIG. 7, the strap-body 12 can loop through an eyelet 120 in the shoulder of the upper 102. In this embodiment, the anchor 16 joins a first portion of the strap-body 12' to a second portion of the strap-body 12". Similar to the embodiments discussed above, the strap-body 12, and in particular the first portion of the strap-body 12', is rotatable relative to the upper 102. The second portion of the strap-body 12" extends from the lateral upper 110 to the medial upper 108 beneath the first portion of the strap-body 12'. Manipulation of the reversible strap 10 according to this embodiment is identical to the embodiment of FIGS. 1-5, permitting the wearer to easily change the aesthetic appearance of the article of footwear 100.

Figure 8:
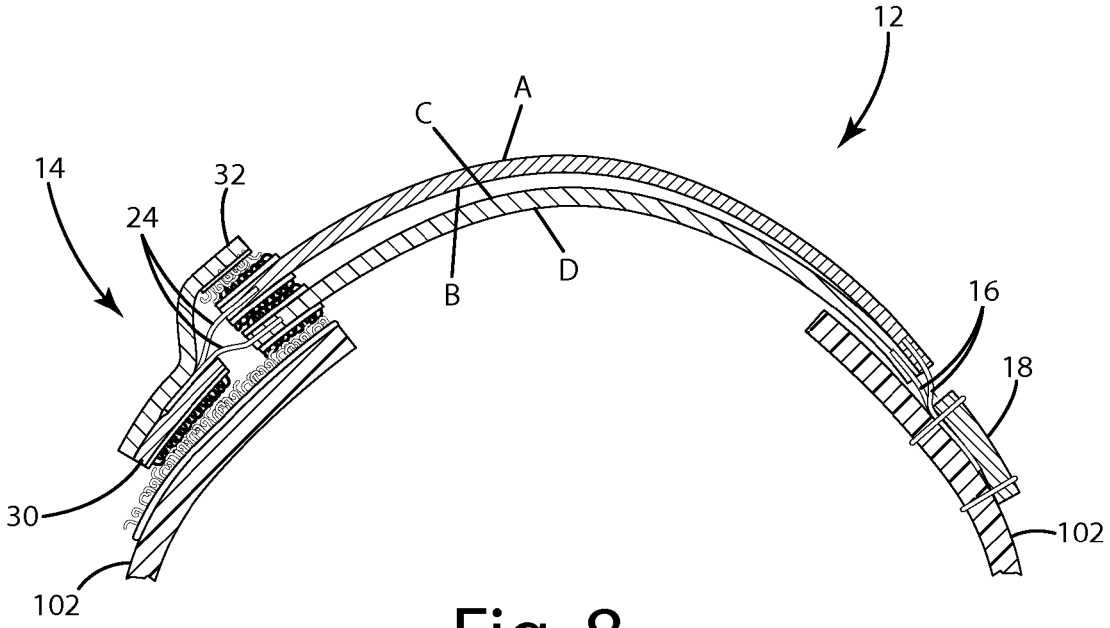
FIG. 8 is a cross-sectional view of the reversible strap of FIG. 1 in accordance with a fourth embodiment.

In another embodiment as shown in FIG. 8, the strap-body 12 includes N-number of coextensive layers that are rotatable with respect to each other. Though two layers are shown in FIG. 8, a greater number of layers can be used in other embodiments as desired. Each layer includes first major surface opposite a second major surface. Each major surface can includes a visual indicia thereon or can serve a discrete functional purpose. In addition, each layer is rotatably coupled to the upper 102, such that each layer can be twisted about its longitudinal axis (independent of the other layer(s)) while remaining coupled to the upper 102. For example, a first anchor 16 can join the top layer to the upper 102, and a second anchor 16 can join the bottom layer to the upper 102. Each layer of the strap-body 12 is also twistable relative to the strap-end 14 with manual manipulation of the corresponding layer. Each layer of the strap-body 12 is joined to the strap-end 14 by a tether 24, in similar fashion to the embodiment shown in FIG. 5. Because each layer includes two surfaces, the present embodiment provides 2·N viewable surfaces for N-number of layers.

The reversible strap 10 of FIG. 8 can be manually manipulated as follows. Beginning from the closed position, the wearer can pull back on the strap-end 14. The strap-end 14 and the strap-body 12 release from the upper 102, drawing back as shown in FIG. 2. From this open position, the wearer can detach the upper layer 32 of the strap-end 14 from the strap-body 12. Once detached, the wearer can shuffle or rotate the desired layer to the top of the strap-body 12. The wearer can then rotate or twist the top layer 180-degrees about its longitudinal axis to ensure the desired surface is visible. The wearer can then reattach the strap-body 12 to the strap-end 14. The wearer can then lower the strap-end 14 and the strap-body 12 as an integrated reversible strap 10 onto the upper 102. From the closed position, the reversible strap 10 now presents a different surface of the strap-body 12.

Though described above in relation to visual indicia, the upper and lower surfaces of the strap-body can instead perform different functions. For example, the upper surface can provide a solar heat absorption function, while the lower surface can provide a heat dissipation function. When twisted, the upper surface can provide a heat dissipation function, and the lower surface can provide a solar heat function. In this regard, the wearer can select between solar heat absorption and heat dissipation. In addition, the upper surface can provide a moisture barrier, and the lower surface can provide a moisture wicking surface. When twisted, the upper surface can release moisture that was absorbed into the moisture wicking surface. In addition, the upper surface can provide a reflective function, while the lower surface can provide a camouflage function. When twisted, the upper surface can provide a camouflage function, and the lower surface can provide a reflective function. In this regard, the wearer can select between reflective and camouflage functions. The reversible strap according to these and other can extend across essentially any portion of the upper, including lateral portions, medial portions, and reverse-facing heel portions, for example.

The strap-body can also include a stacked arrangement of panels joined together in an accordion-like manner. The panels can include different visual indicia thereon, or can perform different functions. Panels joined together in an accordion-like manner are set forth in US Patent Application Publication 2015/0033583 to Loverin et al, the contents of which are incorporated by reference in their entirety. Further by example, the strap-body can include a plurality of panels that are longitudinally joined to each other, such that the wearer can select an upper surface from one of the plurality of panels. Still further by example, a first plurality of panels can be joined to the upper layer of the strap-body along the longitudinal edges thereof, and a second plurality of panels can be joined to the lower layer of the strap-body along the longitudinal edges thereof. The strap-body can be manually manipulated as follows. Beginning from the closed position, the wearer can pull back on the strap-end. The strap-end and the strap-body release from the upper. From this open position, the wearer can detach the upper layer of the strap-end from the strap-body. Once detached, the wearer can manually manipulate the plurality of panels until the desired panel is presented. The wearer can then reattach the strap-body to the strap-end. The wearer can then lower the strap-end and the strap-body as an integrated reversible strap onto the upper. From the closed position, the reversible strap now presents a different surface of the strap-body.

Figure 9:
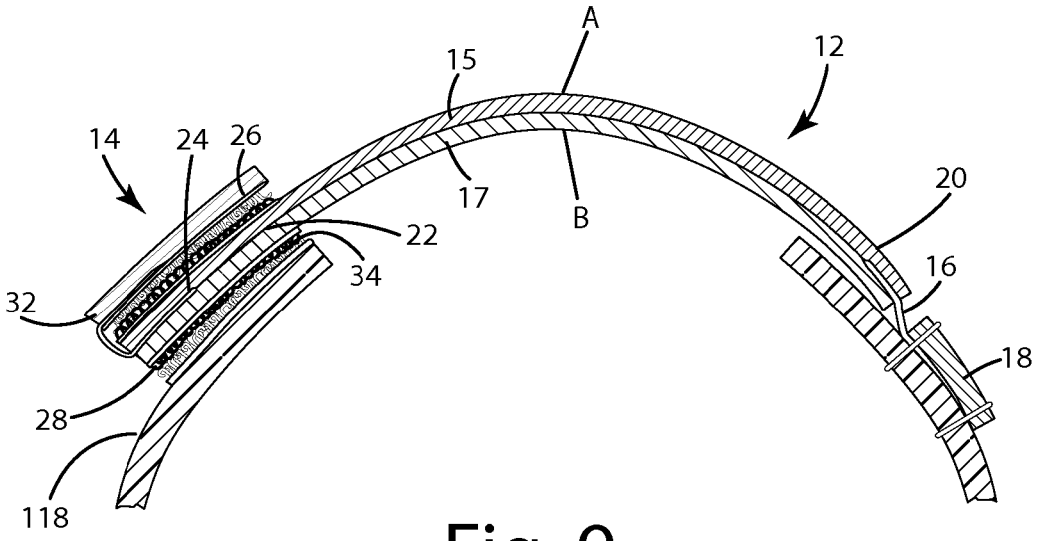
FIG. 9 is a cross-sectional view of the reversible strap of FIG. 1 in accordance with a fifth embodiment.

A reversible strap 10 in accordance with another embodiment is illustrated in FIG. 9. The reversible strap 10 of FIG. 9 is structurally and functionally similar to the reversible strap 10 of FIGS. 1-5, except that the strap-end 14 does not engage the upper 102. Instead, the strap-end 14 includes a panel 32 that engages only the second end portion 22 of the strap-body 12. The strap-end 14 according to this embodiment includes a displayable surface opposite an attachment surface. The displayable surface can complement visual markings on the strap-body 12, and the attachment surface can engage the strap-body 12, such that the strap-body 12 is sandwiched between the panel 32 and the upper 102. The attachment surface can include any attachment, for example a hook and loop attachment, a snap attachment, a friction attachment, or a magnetic attachment, and the panel 32 can be formed of any material, including synthetic textiles, mesh textiles, polymers, leather, or paper, for example.

As also shown in FIG. 9, the strap-end 14 is rotatably joined to the second end portion 22 of the strap-body 12. In particular, the strap-body 12 is twistable relative to the strap-end 14 with manual manipulation of the strap-body 12 when the reversible strap 10 is in an open position. The strap-end 14 can be joined to the strap-body 12 by a tether. The tether can include any construction that is twistable with manual manipulation of the strap-body 12. For example, the tether can include one or more strips of flat shoe lace, round shoe lace, flat elastic gore, round elastic gore, leather, polyurethane, or other textile. Further by example, the tether can include 6 mm wide flat band of elastic gore that extends into a rectangular slot in the periphery of the second end portion 22 of the strap-body 12, the rectangular slot having a width of 6 mm and a depth of 5 mm. Other tether and slot combinations can be used in other embodiments as desired.

In use, the wearer can detach the strap-end 14 from the strap-body 12 and pull back on the strap-body 12. The wearer can then rotate or twist the strap-body 12 relative to the strap-end 14 such that a different surface of the strap-body 12 is visible. The wearer can then lower the strap-body 12 onto the upper 102 and fold the strap-end 14 onto the strap-body 12. Both the strap-end 14 and the upper 102 engage the strap-body 12 to provide improved retention of the reversible strap 10. As in the above embodiments, the upper and lower surfaces of the strap-body 12 can provide different visual indicia or different functional characteristics, and can be modified as discussed above in connection with FIGS. 7-8.

Figure 10:
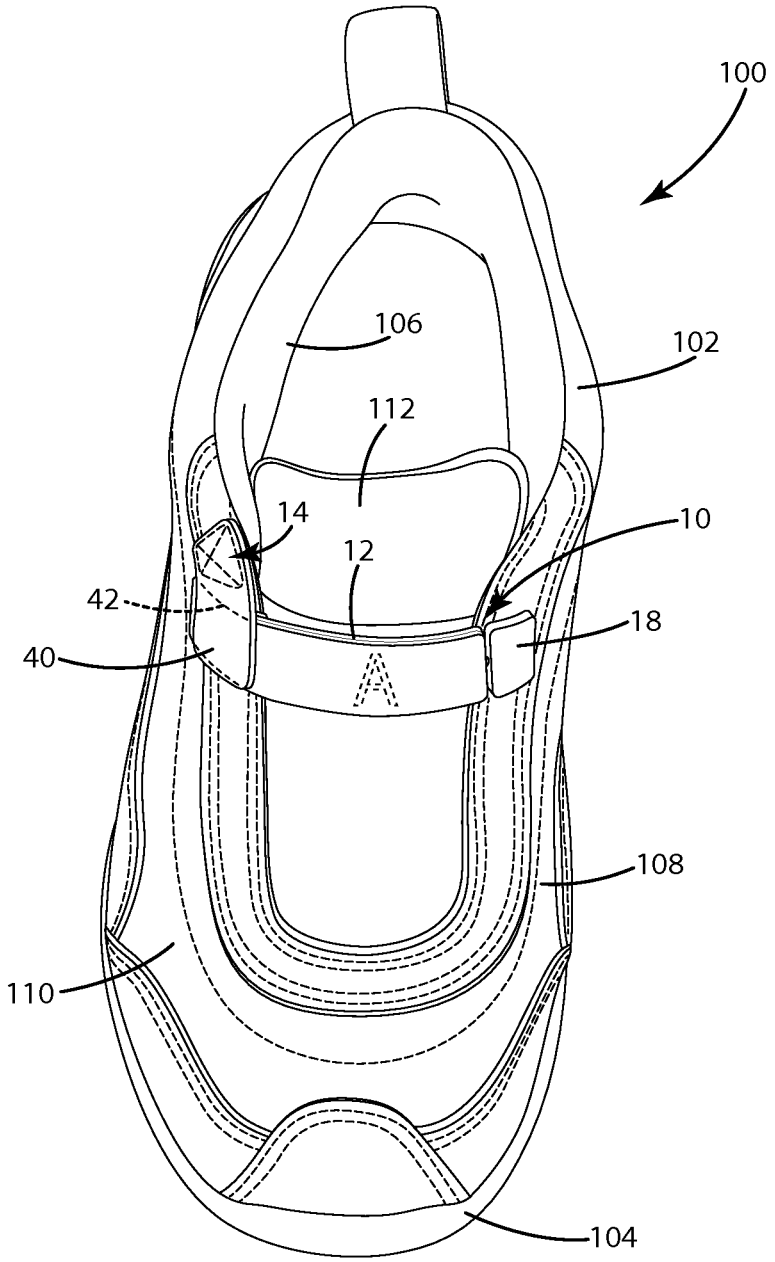
FIG. 10 is a top plan view of an article of footwear including a reversible strap in accordance with a sixth embodiment.
Figure 11:
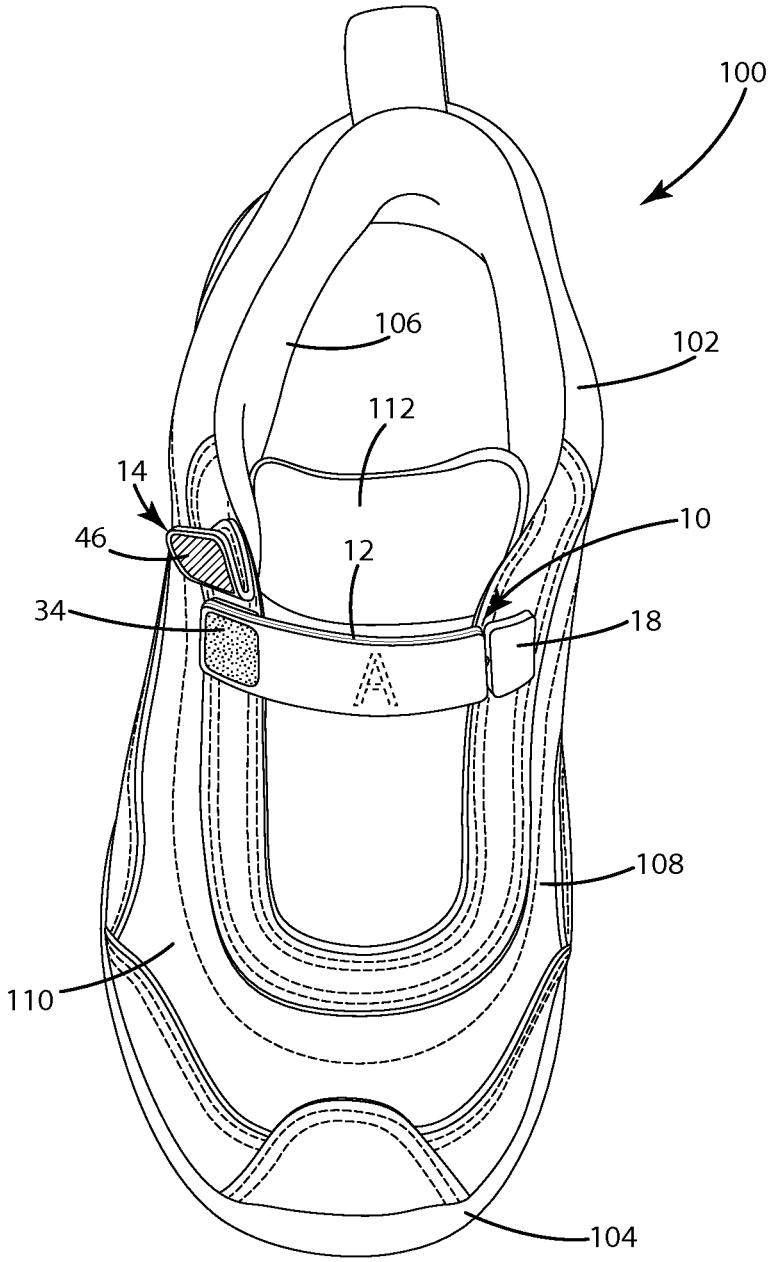
FIG. 11 is a top plan view of an article of footwear including the reversible strap of FIG. 9 having the strap-end in the open position.
Figure 12:
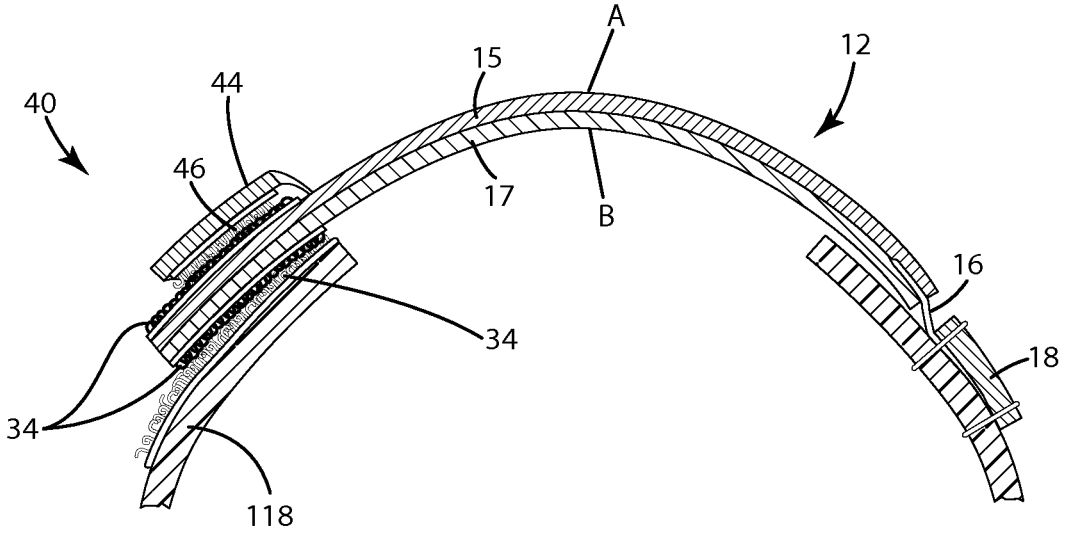
FIG. 12 is a cross-sectional view of the reversible strap of FIGS. 9-10 in accordance with the sixth embodiment.

A reversible strap 10 in accordance with another embodiment is illustrated in FIGS. 10-12. The reversible strap 10 of FIGS. 10-12 is structurally and functionally similar to the reversible strap 10 of FIGS. 1-5, except that the strap-end 14 is non-removably joined to the upper 102, rather than to the strap-body 12. For example, the strap-end 14 can be sewn to the shoulder portion of the upper 102 as shown in FIG. 10. The strap-end 14 includes a panel 40 that is free to flex relative to the upper 102, such that the panel 40 is movable from a closed position as shown in FIG. 10 to an open position as shown in FIG. 11. The panel 40 is an integral component of the strap-end 14 in some embodiments, while in other embodiments the panel 40 is separately formed and joined to the strap-end 14. The strap-end 14 can include a fold-line 42 extending laterally thereacross, such that the panel 40 is free to flex about the fold-line 42. The panel 40 can be formed of synthetic textiles, mesh textiles, polymers, leather, or paper, for example.

As shown in FIG. 12, the panel 40 includes a displayable surface 44 opposite an attachment surface 46. The displayable surface 44 can complement visual markings on the strap-body 12, and the attachment surface 46 can engage the strap-body 12, such that the strap-body 12 is sandwiched between the panel 40 and the upper 102. The attachment surface 46 can include any attachment, for example a hook and loop attachment, a snap attachment, a friction attachment, or a magnetic attachment. The upper 102 can include an identical attachment, for example a hook and loop attachment, a snap attachment, a friction attachment, or a magnetic attachment. These attachments sandwich the strap-body 12 as perhaps best shown in FIG. 12. That is, the second end portion 22 of the strap-body 12 includes a corresponding attachment on upper and lower surfaces thereof 15, 17, for example a hook and loop attachment, a snap attachment, a friction attachment, or a magnetic attachment, on opposing sides thereof, such that either surface can engage the panel 40 and the upper 102.

In use, the wearer can detach the panel 40 from the strap-body 12 and pull back on the strap-body 12. The wearer can then rotate or twist the strap-body 12 such that a different surface is visible. The wearer can then lower the strap-body 12 onto the upper 102 and lower the panel 40 onto the strap-body 12. Both the panel 40 and the upper 102 engage the strap-body 12 to provide improved retention of the reversible strap 10. As in the above embodiments, the upper and lower surfaces of the strap-body 12 can provide different visual indicia or different functional characteristics, and can be modified as discussed above in connection with FIGS. 7-8.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to packages of any specific orientation(s). Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. An article of footwear comprising:
- a sole component;
- an upper joined to the sole component;
- a reversible strap-body having a first end portion rotatably joined to the upper, the reversible strap-body including a second end portion having a first attachment means on a first surface thereof and a second attachment means on a second surface thereof;
- a non-reversible strap-end rotatably joined to the strap-body, such that the strap-body is selectively rotatable with respect to the strap-end between a first position in which the first surface of the strap-body is displayed and a second position in which the second surface of the strap-body is displayed;
- wherein the strap-end operatively engages the first or second attachment means of the strap-body when the strap-body is in a closed position and conceals the second end portion of the strap-body from view.

2. The article of footwear of claim 1 wherein the first surface of the strap-body includes a first visual indicia and wherein the second surface of the strap-body includes a second visual indicia different from the first visual indicia.

3. The article of footwear of claim 1 wherein the first and second attachment means include a hook and loop attachment, a snap attachment, a friction attachment, or a magnetic attachment.

4. The article of footwear of claim 1 further including:
- a first rotatable element joining the first end portion of the strap-body to the upper; and
- a second rotatable element joining the second end portion of the strap-body to the strap-end.

5. The article of footwear of claim 1 wherein the strap-end includes an upper layer to selectively engage the strap-body and a lower layer to selectively engage the upper.

6. The article of footwear of claim 1 wherein the strap-end includes a displayable surface opposite an attachment surface, wherein the attachment surface operatively engages the first or second attachment means of the strap-body when the strap-body is in the closed position.

7. An article of footwear comprising:
- a sole component;
- an upper joined to the sole component;
- a strap-body including:
  - a first end portion that is rotatable with respect to the upper,
  - a second end portion including upper and lower receiving surfaces, and
  - an intermediate portion including opposing first and second surfaces;
- a strap-end including:
  - a first mating surface to selectively engage the strap-body, and
  - a second mating surface to selectively engage the upper,
- wherein the strap-body is rotatable with respect to the upper between a first position in which the first surface of the strap-body is displayed and a second position in which the second surface of the strap-body is displayed, and wherein the upper and lower receiving surfaces of the strap-body end portion are sandwiched between the strap-end and the upper when the strap-body is in a seated position over the upper.

8. The article of footwear of claim 7 wherein the first surface of the strap-body includes a first visual indicia and wherein the second surface of the strap-body includes a second visual indicia different from the first visual indicia.

9. The article of footwear of claim 7 wherein the upper and lower receiving surfaces include a hook and loop attachment.

10. The article of footwear of claim 7 wherein the first and second mating surfaces include a hook and loop attachment.

11. The article of footwear of claim 7 further including a rotatable element joining the first end portion of the strap-body to the upper.

12. An article of footwear comprising:

an upper including first and second side portions; and a footwear strap moveable from a closed position to an open position, the footwear strap including:

a strap-body including a first surface opposite a second surface, the first surface including a first visual indicia and the second surface including a second visual indicia different from the first visual indicia, and a strap-end rotatably joined to the strap-body;

wherein, in the closed position, the footwear strap is positioned across the upper from the first side portion thereof to the second side portion thereof, the strap-body being partially sandwiched between the strap-end and the upper, and the strap-body and the strap-end being releasably attached to the upper, and wherein, in the open position, the strap-end and the strap body are detached from the upper and the strap-body can be rotated relative to the strap-end such that the user can select from among the first visual indicia and the second visual indicia.

13. The article of footwear of claim 12 wherein the strap-end includes a top layer of material that is detachably joined to the strap-body and includes a bottom layer of material fixedly joined to the top layer of material and detachably joined to the upper.

14. The article of footwear of claim 12 wherein the first side portion includes the medial side portion and the second side portion includes the lateral side portion.

15. The article of footwear of claim 14 further including:

a first rotatable element joining the medial side portion of the upper to the strap-body; and a second rotatable element joining the strap-end to the strap-body.

16. The article of footwear of claim 12 wherein the strap-body includes an end portion having an attachment means on opposing sides thereof.

17. The article of footwear of claim 16 wherein the attachment means includes a hook and loop attachment, a snap attachment, a friction attachment, or a magnetic attachment.

18. The article of footwear of claim 12 wherein the strap-body extends across an opening in the upper such that the strap-body is a closure.

19. An article of footwear comprising:

a sole component;

an upper joined to the sole component;

a strap-body including:

a first end portion rotatably joined to the upper, a second end portion including upper and lower attachment means, an intermediate portion including opposing first and second surfaces, wherein the strap-body is rotatable with respect to the upper between a first position in which the first surface is displayed and a second position in which the second surface is displayed; and a strap-end joined to the upper and including a panel, the panel having a displayable surface opposite an attachment surface, wherein the attachment surface operatively engages the first or second attachment means of the strap-body when the strap-body is in a closed position to conceal the second end portion of the strap-body from view, and wherein the other of the first or second attachment means of the strap-body engages the upper.

20. The article of footwear of claim 19 wherein the first surface of the strap-body includes a first visual indicia and wherein the second surface of the strap-body includes a second visual indicia different from the first visual indicia.

21. The article of footwear of claim 19 wherein the first and second attachment means include a hook and loop attachment, a snap attachment, a friction attachment, or a magnetic attachment.

* * * * *